United States Patent [19]

Block

[11] 4,170,118

[45] Oct. 9, 1979

[54] EARRING

[75] Inventor: Alvin Block, Bedford, N.Y.

[73] Assignee: Intimate Jewels, Inc., Katonah, N.Y.

[21] Appl. No.: 908,059

[22] Filed: May 22, 1978

Related U.S. Application Data

[63] Continuation-in-part of Ser. No. 875,246, Feb. 6, 1978.

[51] Int. Cl.[2] ..... A44C 7/00

[52] U.S. Cl. ..... 63/12; 85/36

[58] Field of Search ..... 63/12, 13; 85/36

[56] References Cited

U.S. PATENT DOCUMENTS

| | | | |
|---|---|---|---|
| 418,693 | 1/1890 | Day | 85/36 |
| 439,457 | 10/1890 | Whittemore et al. | 63/12 UX |
| 733,263 | 7/1903 | Nordt | 63/12 |
| 1,243,859 | 10/1917 | Neider | 85/36 UX |

FOREIGN PATENT DOCUMENTS

| | | | |
|---|---|---|---|
| 866949 | 6/1941 | France | 85/36 |
| 295468 | 3/1954 | Switzerland | 63/12 |

*Primary Examiner*—F. Barry Shay
*Attorney, Agent, or Firm*—Kirschstein, Kirschstein, Ottinger & Cobrin

[57] ABSTRACT

An improvement in post-type earrings, which are earrings connected to a human ear by a rigid slender short rod or post. One end of the post is attached to an ornament. The post is rectilinear and cylindrical and extends from attachment to the ornament. In service, the other end of the post is pushed through an opening in a person's ear, and a suitable element is attached to the other end of the post to secure the earring on the ear. In the present invention, at least a portion of the outer surface of the post has a helical threading. The element used to secure the post on the ear is a clutch having a terminal first central opening about which are radially arrayed a plurality of spaced apart springy fingers. The fingers extend to terminal attachment to a disc-shaped base portion of the clutch having a second central opening. The clutch is engageable by the post by extending the post axially through the openings in the clutch, until the tips of the springy fingers pass over the convolutions of the threading and are held in the threading. The fingers cannot be moved reversely in an axial direction because in this direction they catch on the flanks of the threads. To disengage the clutch from the post, the clutch must be rotated about the post, so that in effect the clutch is pushed on axially and screwed off by rotary motion.

1 Claim, 4 Drawing Figures

FIG. 1
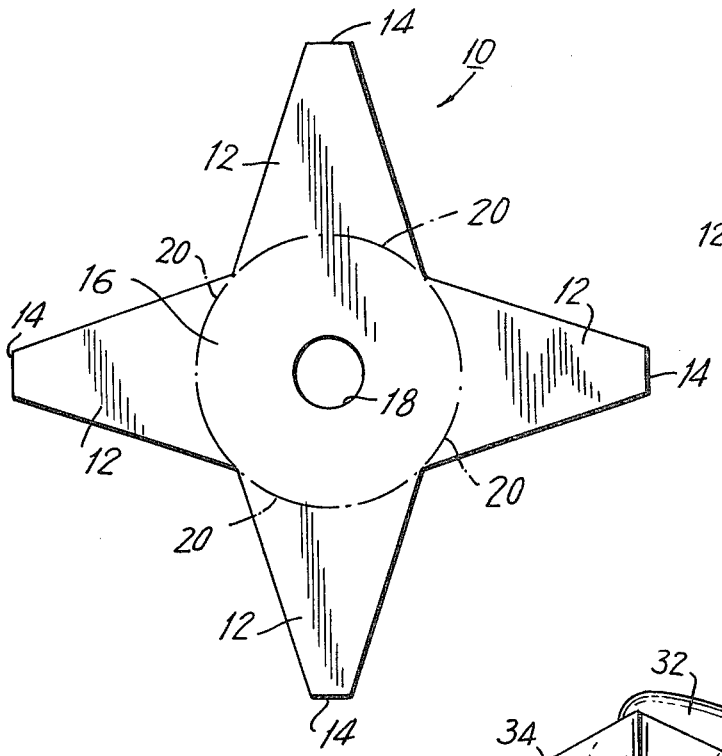
FIG. 2
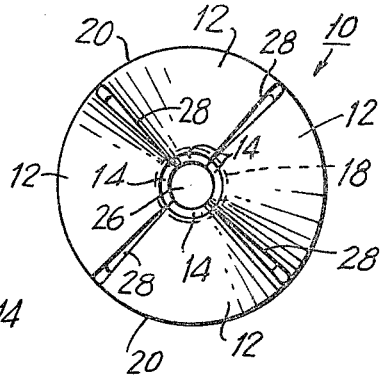
FIG. 3
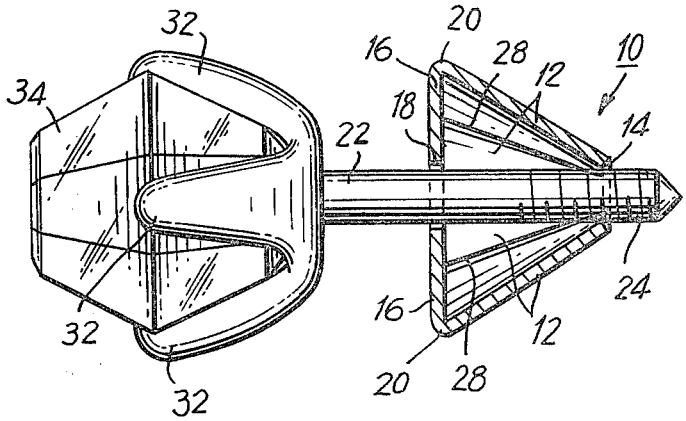
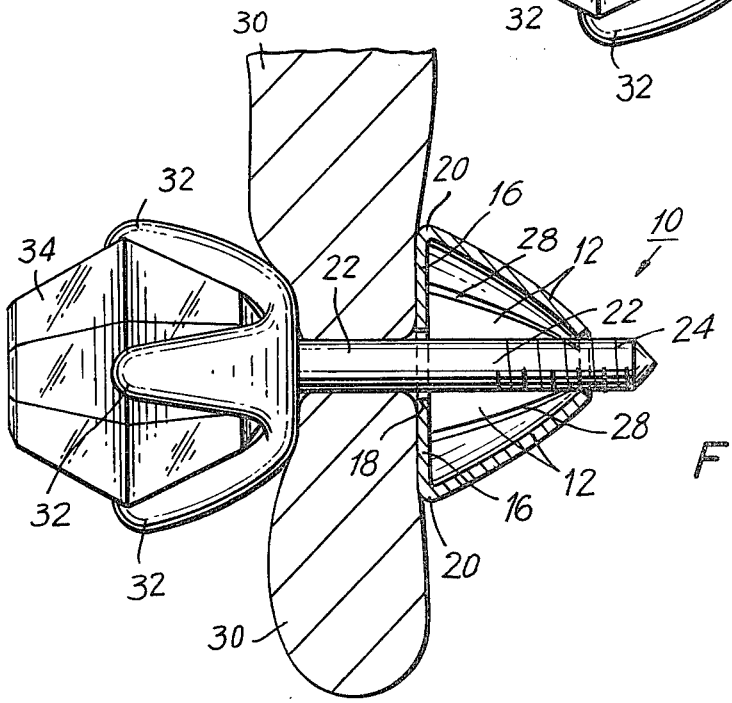
FIG. 4

EARRING

CROSS-REFERENCE TO RELATED APPLICATION

The present application is a continuation-in-part of U.S. patent application Ser. No. 875,246 filed Feb. 6, 1978.

BACKGROUND OF THE INVENTION

1. Field of the Invention

A post-type earring for pierced ears.

2. Description of the Prior Art

There are two kinds of earrings that are used for pierced ears. One is the so-called "wire" earring. The other is the so-called "post" earring. In a wire earring, the dangling ornament is provided with a U-shaped thin wire at one end of the ornament. One branch of the U is connected to the ornament permanently, the other end of the U is threaded through a person's ear and then is engaged with a catch of the ornament.

A post earring is connected to an ear by a rigid slender short rod or post. One end of the rod is attached to the ornament; the other end of the rod is pushed through the opening in a person's ear, and then a friction nut is slid onto this other end. This nut has a central opening defined by the tips of a plurality of resilient fingers. The fingers frictionally engage on the rod or post. The friction nut slides onto the post easily and slides off with difficulty. The problem with this type of prior art earring is that the friction nuts can become displaced accidentally, for instance, while the person is engaged in physical exertion or sleeping.

Amont the prior art on this type of earring may be mentioned U.S. Pat. Nos. 2,882,702 and 2,373,002.

SUMMARY OF THE INVENTION

1. Purposes of the Invention

It is an object of the present invention to provide an improved earring.

Another object is to provide an improved post-type earring.

A further object is to provide a post-type earring in which the friction nut or clutch is pushed on and screwed off.

An additional object is to provide a post-type earring in which the clutch is self-locating onto the post due to the provision of a disc-shaped base portion of the clutch having a central opening.

Still another object is to provide a post-type earring in which the clutch is mounted on the post by a ratchet-like movement but must be screwed off for removal of the post.

Still a further object is to provide a post-type earring in which the clutch is shaped to provide a stronger ratchet and better ratchet effect as well as a stronger overall structure.

Still an additional object is to provide a post-type earring in which the hole in the rear clutch at the terminus of the fingers is self-locating so that a woman emplacing the earring is assisted in getting the post into the hole.

An object is to provide a post-type earring in which the post is cammed into the hole in the clutch at the terminus of the fingers.

An object is to provide an earring which cannot be dislodged by strenuous physical activity or the like, but only by screwing the clutch or friction nut off the post.

An object is to provide an earring in which the clutch is readily emplaced on the post and yet is not easily accidentally dislodged when once emplaced, and is only removable by the positive and conscious effort of screwing the clutch off the post.

These and other objects and advantages of the present invention will become evident from the description which follows.

2. Brief Description of the Invention

The present earring post differs from a conventional post in that instead of a smooth post, a post is provided with a threaded helix, and also in that instead of the usual friction clutch, a clutch is provided with a disc-shaped base member having a central opening and springy fingers. When this clutch is pushed onto the post, it can slide smoothly in an engaging direction, there being a ratchet-like passage of the tips of the fingers over the crests of the convolutions of the threads. However, the fingers cannot be moved reversely in an axial direction, because in an axial direction they catch on the flanks of the threads. To remove the clutch and thereby release the post, the fingers have to be rotated about the post. Thus, the present concept entails an axial push type engagement of the clutch, with rotary disengagement. In other words, where the conventional post was smooth, the new post is formed with a helical rib, i.e., a thread. The new post is used in the same way as the old one, that is to say, it is pushed through a person's ear and then a clutch, i.e., a friction nut, is pushed on to it. However, the clutch cannot be pulled off, because the thread is too great an impediment to axial removal of the clutch. Instead, it must be screwed off.

To summarize, the present earring for pierced ears includes an ornament, a rectilinear cylindrical post, and a clutch. The post extends from attachment to the ornament. At least a portion of the outer surface of the post has a helical threading. The clutch has a terminal first central opening defined by the tips of a plurality of radially-extending fingers. In other words, a plurality of spaced apart springy fingers are radially arrayed about a first central opening in the clutch. The fingers extend to terminal attachment to a base portion of the clutch, consisting of a disc-shaped base portion of the clutch having a second central opening. In other words, the clutch is of conical configuration. Thus, the clutch is engageable by the post by extending the post axially through the openings in the clutch, so that the tips of the fingers pass over the convolutions of the threading. The clutch may be disengaged from the post only by rotating the clutch.

In most instances, the fingers will converge outwards from the plane of the disc-shaped base portion, so that the fingers define a concave recess for entry of the post into the first central opening the clutch. In this case, typically the fingers are curved, so that the curved fingers define a cup-shaped extension from the central base, which extension defines the concave recess.

The base is usually disc-shaped. The outer end portion of the post may be free of threading and/or may be tapered, with the outer end terminus of the post being of minimum cross-sectional area.

The present earring provides several salient advantages. The present improved post-type earring features a friction nut or clutch which is pushed on and screwed off, thus an improved earring fastening means is provided which is readily mounted on the post, yet is secure and not removable except by screwing off. Thus, the clutch is mounted on the post by a ratchet-like movement, but must be screwed off for removal from the post. The clutch is self-locating onto the post, because of the configuration of the disc-shaped central base member and especially the fingers which provide a cup-like concave recess for ingress of the post. The clutch is shaped to provide a stronger ratchet and a better ratchet effect. The first hole in the rear or back clutch is self-locating so that a woman emplacing the earring is assisted in getting the post into the first hole, i.e., the post is cammed into the first hole in the clutch. The present earring when once emplaced cannot be dislodged by strenuous physical activity or the like, but only when the clutch or friction nut is screwed off. Thus, an advantage is that the clutch is readily emplaced on the post simply by pushing it onto the post, and yet the clutch cannot be accidentally dislodged when once emplaced, and is only removable by the positive and conscious effort of screwing the clutch off the post.

The invention accordingly consists in the features of construction, combination of elements, and arrangement of parts which will be exemplified in the article of manufacture hereinafter described and of which the scope of application will be indicated in the appended claims.

BRIEF DESCRIPTION OF THE DRAWINGS

In the accompanying drawings in which are shown several of the various possible embodiments of the invention:

FIG. 1 is a plan view of the clutch prior to bending of the fingers into the new configuration, i.e., in FIG. 1 the clutch as fabricated is flat;

FIG. 2 shows, in top or plan view, the finished clutch with the fingers bent to a final shape;

FIG. 3 shows a clutch with rectilinear fingers, in place on a threaded post of an earring in sectional elevation view; and FIG. 4 shows a clutch with curved fingers, in place on a threaded post of an earring in place on an ear lobe, in sectional elevation view.

DETAILED DESCRIPTION OF THE PREFERRED EMBODIMENTS

Referring now to FIG. 1, the clutch 10 is shown in flat blank form and prior to bending of the base of fingers 12 to the final configuration. Each of the four fingers 12 is of generally triangular shape with a truncated end 14; although in alternative embodiments, the ends 14 could be curved or even pointed with an apex. In any event, the fingers 12 radiate from a central disc-shaped base member 16 having a central opening or hole 18.

In the final assembly of the clutch from the flat FIG. 1 configuration to the final FIG. 2 disposition, the fingers 12 are bent about curved bending lines 20 which are typically of a circular orientation in toto, as shown in FIG. 1. Alternatively, the bend lines 20 may be hemi-elliptical, hemi-oval or even rectilinear. In any case, the final clutch 10 in FIG. 2 assumes a conical configuration. Preferably, however, the bend lines 20 will be curved so that the final base member 16 is disc-shaped with a circular perimeter 20 (FIG. 2).

FIG. 3 shows the complete earring with the clutch 10, having rectilinear fingers 12, mounted on a post 22 having a threaded terminal end portion 24. The mounting of the clutch 10 on the post 22 has been accomplished by extending or threading the post 22 through opening 18, and then by sliding the terminal ends of the fingers 12 defined by ends 14 onto the threaded end 24 of post 22. The clutch 10 is characterized by the provision of the plurality of springy fingers 12, the tips or ends 14 of which define a first central opening 26 (FIG. 2) in which the threaded section 24 of post 22 has been lodged by simple rectilinear movement of the post 22 end 24 through opening 26. FIGS. 2, 3 and 4 also show the radial orientation of the fingers 12 which are separated by slits 28. FIG. 4 shows the earring as mounted on an ear lobe 30; in FIG. 4 the fingers are curved for strength and to engage the threaded portion 24 of the post 22. FIGS. 3 and 4 also show the terminal arms 32 holding an ornament 34 at the end of the post 22 opposite to the threaded end 24.

The spring-like nature of the fingers 12 insures a yielding when the clutch 10 is pushed onto the post 22, however, the configuration of the fingers 12, namely the inclination of the fingers 12 out of the plane of the base 16 of the clutch 10 so as to form a concave recess, insures that the clutch 10 cannot be pulled off of the post 22 but must be screwed off in all cases. The disc-shaped base member 16 having a circular perimeter 20 and a central circular hole or opening 18 provides greater strength to the clutch 10, as well as insuring the guidance of the post 22 towards opening 26 for engagement by the tips or ends 14, i.e., the presence of central opening 18 properly aligns the post 22. It should be noted that the opening 18 is of greater diameter than the post 22 and does not engage the threaded portion 24.

It thus will be seen that there is provided an earring which achieves the various objects of the invention and which is well adapted to meet the conditions of practical use.

As various possible embodiments might be made of the above invention, and as various changes might be made in the embodiments set forth above, it is to be understood that all matter herein described or shown in the accompanying drawings is to be interpreted as illustrative and not in a limiting sense. Thus, it will be understood by those skilled in the art that although preferred and alternative embodiments have been shown and described in accordance with the Patent Statutes, the invention is not limited thereto or thereby.

Having thus described the invention, there is claimed as new and desired to be secured by Letters Patent:

1. An earring for pierced ears which comprises an ornament in a setting, a rectilinear cylindrical post extending from said ornament setting, at least a portion of the outer surface of said post having a helical threading, and a clutch, said clutch having a central disc-shaped base portion having a circular central opening and a circular perimeter, and a plurality of spaced-apart springy fingers, said springy fingers extending radially from truncated terminal tips defining a circular opening, to a curved attachment to the circular outer perimeter of said base portion, said curved attachments forming, in combination, the circular outer perimeter of said base portion, so that said clutch is substantially conical, said clutch being engageable by said post by extending said post axially through the central opening in said base portion and then through the opening defined by the terminal tips of said fingers, whereby the tips of said fingers pass over the convolutions of the threading, and so that said clutch cannot be disengaged from said post by reverse axial movement but may be disengaged from said post only by rotating said clutch, the circular central opening and the circular perimeter of the base portion of said clutch being concentric, and the circular opening defined by the truncated terminal tips of said fingers being coaxial with the circular central opening of the base portion of said clutch, so that, when said post is extending axially through the circular central opening in said base portion and then through the circular opening defined by the truncated terminal tips of said fingers, the helical threading on the outer surface of said post is coaxially aligned with the circular opening defined by the truncated terminal tips of said fingers, a portion of said helical threading then being continguous with the truncated terminal tips of said fingers so that said truncated terminal tips engage said portion of said helical threading, adjacent fingers of said plurality of springy fingers being spaced apart so that radial slots are defined between adjacent fingers, each slot having side walls which diverge continuously away from each other in direction from the opening defined by the truncated terminal tips of the fingers to the circular outer perimeter of the base portion, said side walls of each slot being in substantial engagement with each other at the opening defined by the tips to thereby securely engage the post about substantially its entire periphery, said side walls of each slot being spaced further apart of each other at the circular outer perimeter to thereby increase the resiliency of the fingers thereat.

* * * * *